United States Patent [19]

Garcea

[11] 4,022,019

[45] May 10, 1977

[54] EXHAUST CONVEYING SYSTEM FOR INTERNAL COMBUSTION ENGINES

[75] Inventor: Giampaolo Garcea, Milan, Italy

[73] Assignee: Alfa Romeo S.p.A., Milan, Italy

[22] Filed: May 30, 1973

[21] Appl. No.: 365,151

Related U.S. Application Data

[63] Continuation-in-part of Ser. Nos. 198,742, Nov. 15, 1971, abandoned, and Ser. No. 285,192, Aug. 31, 1972, abandoned.

[30] Foreign Application Priority Data

Nov. 20, 1970 Italy ..... 32012/70

[52] U.S. Cl. ..... 60/282; 60/323; 138/122

[51] Int. Cl.[2] ..... F01N 7/10

[58] Field of Search ..... 60/272, 282, 323; 181/36 B, 35 C; 138/173, 122, 121; 55/269

[56] References Cited

UNITED STATES PATENTS

| | | | |
|---|---|---|---|
| 2,204,294 | 6/1940 | Blanchard | 60/310 |
| 2,770,313 | 11/1956 | Johnson | 181/36 B |
| 3,043,094 | 7/1962 | Nichols | 60/323 |
| 3,060,069 | 10/1962 | Sindars | 138/122 |
| 3,104,734 | 9/1963 | Ludlow | 181/36 B |
| 3,133,612 | 5/1964 | Sailler | 181/36 B |
| 3,457,723 | 7/1969 | Kerns | 60/282 |
| 3,581,494 | 6/1971 | Scheitlin | 60/282 |
| 3,740,930 | 6/1973 | Cullom | 55/269 |
| 3,750,403 | 8/1973 | Deutschmann | 60/272 |
| 3,768,260 | 10/1973 | Glenn | 60/282 |

FOREIGN PATENTS OR APPLICATIONS

| | | | |
|---|---|---|---|
| 704,741 | 2/1931 | France | 181/36 B |
| 392,852 | 5/1933 | United Kingdom | 60/322 |

*Primary Examiner*—Douglas Hart
*Attorney, Agent, or Firm*—Holman & Stern

[57] ABSTRACT

An exhaust conveying system for internal combustion engines, in which the exhaust pipes connecting the engine head with a single exhaust manifold comprise each at least a pair of tubular members, at least one of the tubular members being made of thin sheet having circumferential corrugations, with the crests of the corrugations being adherent to the surface of the other tubular member so as to define air spaces between the tubular members. As consequence, the heat losses from the exhaust pipes are strongly reduced, thus improving the post-combustion of unburned components of the exhaust gases which takes place downstream of the exhaust pipes. The exhaust pipes can also be provided with a porous layer of a ceramic material bonded to their inner wall.

2 Claims, 13 Drawing Figures

EXHAUST CONVEYING SYSTEM FOR INTERNAL COMBUSTION ENGINES

RELATED APPLICATIONS

This is a Continuation in Part Application of my U.S. patent applications Ser. No. 198,742, filed Nov. 15, 1971, now abandoned and Ser. No. 285,192, filed Aug. 31, 1972, now abandoned

BACKGROUND OF THE INVENTION

It is known that one of the means adopted for decreasing the amount of unburned components in the exhaust gases of internal combustion engines is to encourage an additional combustion of said components downstream of the engine exhaust valves (that is, after that the exhaust gases have left the cylinder, but in the interior of the exhaust system and upstream of the point at which the exhaust gases reach the atmosphere).

Such an additional combustion can take place by resorting to oxygen which is possibly still contained in the exhaust gases, or, as an alternative, by exploiting air which is specially fed into the exhaust system.

It is likewise known that such a combustion can take place only if the temperature of the exhaust gases is above a certain magnitude, so that it becomes profitable, if not imperative, to prevent the cooling of the exhaust gases not only in the zone of the exhaust system in which the additional combustion should take place, but also in the section located between the engine head and said post-combustion area.

It is known, moreover, that in many engines, more particularly in motor-car engines, the exhaust system is so designed as to utilize, in order to improve the volumetric efficiency, the pressure pulsations in the interior of the exhaust system so as to increase the specific horsepower of the engine: in such a case, the optimum cylinder filling is generally obtained by keeping separate from each other, along a certain length, the exhaust ducts communicating with the individual cylinders and emerging from the engine head. Thus, the portion of the exhaust system which lies in the neighborhood of the engine head has, in such engines, a considerable branching off, with a very high external surface which favors the dispersion of heat and the cooling of exhaust gases.

Whenever it is desirable, on engines of the kind referred to above, to obtain an additional combustion of the exhaust gases as outlined in the foregoing, such heat dispersion must be limited as far as practicable, by resorting to heat-insulation: this problem,however, is not easily solved, on account of the fact that the heat insulation assembly should withstand very high temperatures (especially when the engine displays its maximum horsepower), mechanical fatigue stresses due to vibrations, and mechanical stresses due to different thermal expansion coefficients: in addition, the heat insulation must be susceptible of mass production at economically acceptable costs.

OBJECTS AND SUMMARY OF THE INVENTION

Accordingly, it is a principal object of the present invention to provide an exhaust manifold which essentially comprises discrete exhaust pipes having such an inside diameter and length as to render the engine horsepower as high as practicable by exploiting the improved filling effect due to pressure pulsations, these pipes, flanged to the engine head at either end and properly bent so as to fulfil the space shortage requirements, merge together at the other end, each of the exhaust pipes comprises at least a pair of tubular members, one within the other, at least one of the said tubular members being made of a thin corrugated sheet at least in the curved sections, the corrugations extending over the whole circumference of the tubular member and the crests of the corrugations being adherent to the surface of the other tubular member so as to define substantially closed air spaces between the tubular members.

The air contained in the spaces is kept stationary so as to reduce the convertion losses, whereas the glossy surfaces of the tubular members reduce the radiation losses.

In one embodiment of the invention, one or more corrugated tubular members are arranged over an inner smooth tubular member.

According to another preferred embodiment, the corrugated tubular member is arranged internally of an outer smooth tubular member.

Relating to the first embodiment of the invention, an essential feature is the fact that the outer tube is corrugated and said corrugations have preferably a circumferential trend: thus, the outer tube, possibly obtained from a longitudinally creased steel strip which is helically wound and the adjoining edges of consecutive spirals are seam folded, acquires such a flexibility as to be able to be slipped onto the inner tube even if the latter exhibits a considerable curvature, since the inner edges of the corrugations adhere to the surface of the inner tube, with the result being that the outer tube is centered and positioned with respect to the outer tube: the latter, due to its being smooth, has a stiffness which is adequate to maintain its preselected shape. The resilient yielding of the corrugated tube, enables it to accommodate with ease the different thermal expansions of the two tubes (due to the temperature differentials) without causing mechanical stresses due to such differences. On account of the reduced heat conductivity of stainless steel (which forms the outer tube), of its reduced thickness and also on considering the limited contact area between the inner tube and the outer tube, the conduction heat flow therebetween is also reduced, whereas the air enclosed and maintained stationary within the jacket minimized the heat convection losses of the inner tube. The radiaiton losses are obviously reduced inasmuch as stainless steel, which also forms the inner tube, retaines, in spite of the lapse of time sufficiently glossy and reflective surfaces.

Should a certain clearance exist between the two tubes and the resilient bias of the outer tube does not succeed in maintaining the outer tube fixed with respect to the inner one (especially when vibrations are experienced), circular locking clips can be provided, for example, at the tube ends or in specially selected points. If necessary, the outer tube can have, in the clip area, a longitudinal cut to facilitate blocking. Inasmuch as at the ends, for example, at the engine head side, the several portions of the inner tube have welded flanges, it is obvious that the corrugated outer tube should be slipped onto the inner tube prior to flange welding. Whenever it becomes necessary further to reduce the heat losses towards the outside, provisions are made, according to the present invention, for lining the inner tube with a plurality of thin metal sheet tubes slipped one over the others and, of course, separated by a layer of stagnant air. An essentail feature of these tubes is still to be corrugated but, in this case, the direction of the corrugations of the one tube must be set at an angle with respect to the direction of the corrugations of the adjoining tube (s). By so doing, the corrugations of the adjoining tubes are not balanced with one another and mutual spacing is ensured together with the consequent presence of an air layer therebetween.

A further possibility is also provided for the manifold the subject of the present patent application: that is to say the possibility of providing an air gap also in communication with the areas in which the individual tube branches conjoin. Such an air gap is obtained with stiff shells of a thin deep drawn sheet, also of stainless steel, with said shells being welded to the inner tubes or the flanges adjacent to either end only.

Thus, possible differences of thermal expansion do not give rise to internal mechanical tensions (which are dangerous as they may cause deformations, breakages and so forth) and, even if not sealtight joint is made at the opposite end, the air trapped in the gap is maintained adequately stationary and convection losses are likewise minimized.

When the necessity is felt of having a certain amount of preheated air (for example in wintertime for keeping constant, at a preselected magnitude, the temperature of the air drawn by the engine by properly admixing said preheated air with the atmospherical air), the shell can have a mouth for connection with the engine air intake, care being taken so that the required airflow may enter without any excessive pressure, the gap between the shell and the tube connection.

The corrugation of the outer tube can, of course, be circular (lying on a plane perpendicular to the axis) or, as an alternative, helical with one or more spirals and this in connection with the technological ease of producing such a tube.

In an exhaust pipe system of the kind as hereinbefore described, comprising inner smooth tubes and outer corrugated tubes, it has been noticed that:

a. The material of which the conveying system is brought, due to the outer insulating layer, to very high temperatures, so that it becomes imperative to resort to material having an improved heat resistance, which thus are more expensive.

b. During the transitional stages (more particularly upon starting a cold engine), a considerable amount of heat passes from the gases to the material which forms the conveying system: during these transitional stages, the gas thus undergoes a considerable cooling which can hinder possible postcombustion reactions of the unburned components.

According to further improvements provided by the present invention, the thermal insulation of the exhaust gas conveying system, or of certain sections thereof, is embodied in the inside of the walls which form the exhaust gas conveying system. The walls themselves are thus, rather than heated, cooled by the effect of the thermal insulation. Not only the materials as used at present should not be replaced by more expensive materials, but a possible substitution of cheaper materials therefor becomes practicable. In addition, the cooling of the exhaust gases during the thermal transitions is reduced to a minimum.

According to a preferred embodiment of the invention, a stationary gaseous fluid is inserted between the exhaust gases and the walls of the conveying system and fills a gap which is embodied by an additional wall made of a thin metal sheet, which is preferably corrugated, made of stainless steel, or, as an alternative, the gaseous fluid is contained within a considerably porous layer of a ceramic material sticking to the inner surfaces of the walls of the conveying system.

The above will become more clearly apparent from the accompanying FIGS. 1 to 13, in which possible emboidments of the device according to the present invention are shown by way of example only and without limitation.

DETAILED DESCRIPTION OF THE EMBODIMENTS

Figure 1:
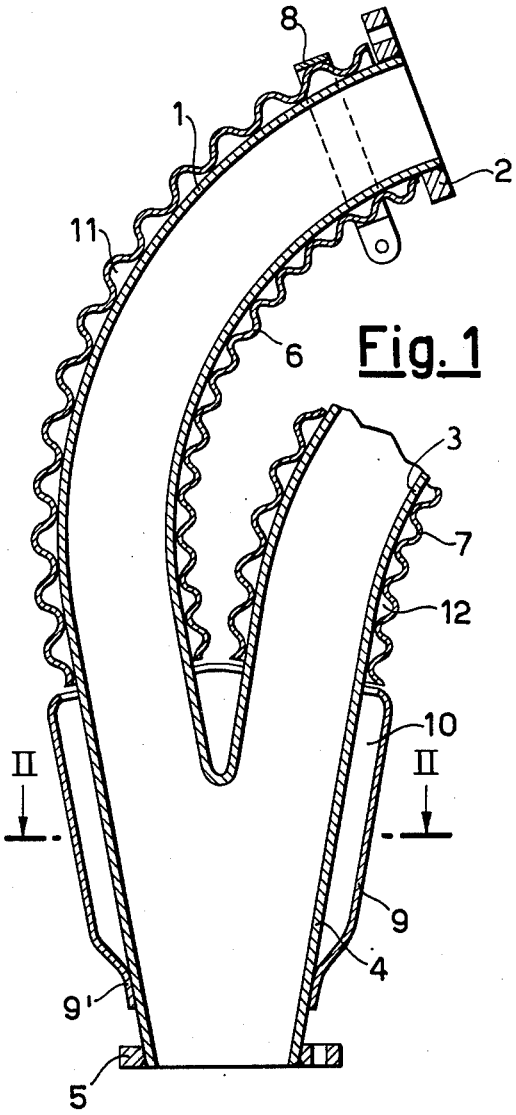
FIG. 1 is a view in cross-section of the exhasust system for an internal combustion engine.

In FIG. 1, which shows the exhaust system for an internal combustion engine, numeral 1 indicates the exhaust pipe or tube of a cylinder, 2 is a head flange applied to the tube by welding, with said flange being affixed to the engine head in registry with the opening of the exhaust duct as formed through the engine head (not shown in the figure). Numeral 3 indicates the discharge pipe or tube of another cylinder. Both tubes 1 and 3 combine into a single tube 4 which is connected, by the agency of a flagne 5 welded thereto, to the counterflange of the further exhaust tube of the engine (not shown in the figure). Outer tubes 6 and 7, made of corrugated stainless steel sheet, for example, with circular corrugations, adhere, by the agency of the inner edges fo their corrugated surface to the inner tube 1 and 3, so as to provide two jackets 11 and 12 which, as filled with air, with form an insulating layer on the linner tubes, said layer being adapted considerably to reduce the heat transfer towards the outside atmosphere.

The outer tube, whenever necessary, can be clamped onto the inner tube by a circular clip 8, as applied, for example, to either end, such as shown in the drawing.

In the area where the exhaust pipes coming from the individual cylinders merge into the single tube 4, the lining of the single tube 4 is obtained by a shell of smooth sheet metal as shown at 9. The shell 9 is fastened to the tube 4 at end 9' by welding, and, at the opposite end, it is left free so as to allow for thermal expansions.

Figure 2:
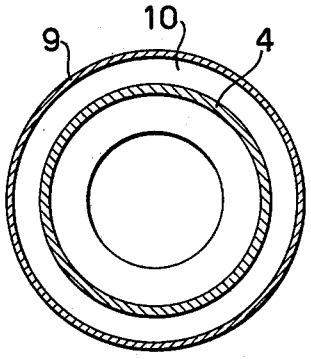
FIG. 2 is a view taken along line II—II of FIG. 1, the view looking in the direction of the arrows.

In FIG. 2 can be seen an annualr gap 10 as formed by the single tube 4 and the lining shell 9.

Figure 3:
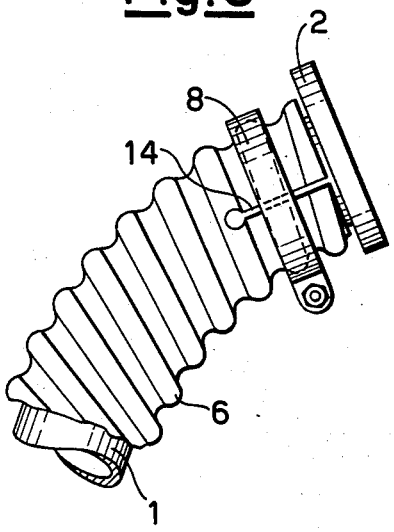
FIG. 3 is a fragmentary view in elevation of the corrugated tube adjacent the head flange provided with a slot.

FIG. 3 shows the corrugated tube 6, the flange 2 and the circular clip 8 and a slot 14 formed in the corrugated tube so as to encourage blocking by means of the circular clip 8, of the outer tube 6 relative to the inner tube 1.

Figure 4:
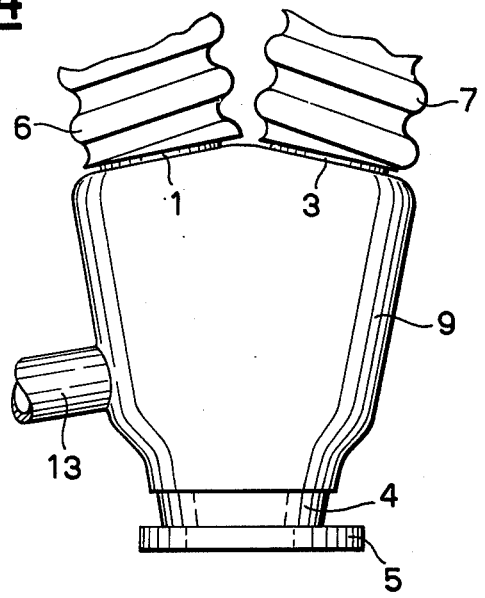
FIG. 4 is an elevational view of the shell secured to the tube with which the exhaust pipes merge.

FIG. 4 shows the shell 9 as welded to the tube 4, in the neighborhood of the flange 5. In FIG. 4, there is shown at 13 a possible duct for the preheated air, to be connected to the engine air intake (as outlined above).

Figure 5:
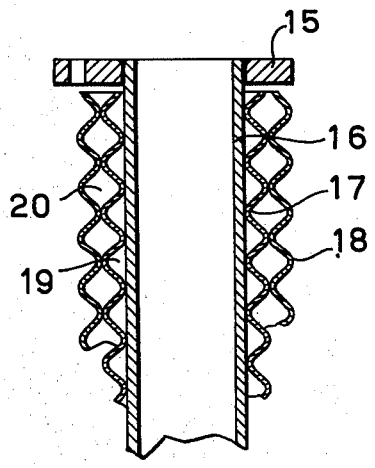
FIG. 5 is a view in cross-section of an exhaust system provided with a twin stainless steel sheet tube.
Figure 6:
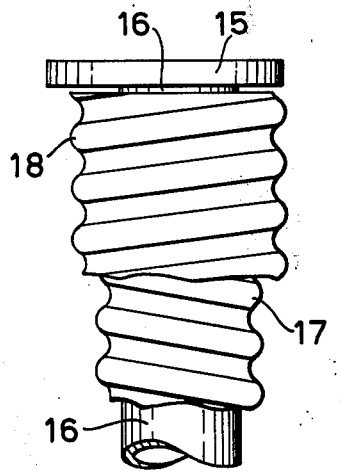
FIG. 6 is a view in elevation of the arrangement shown in FIG. 5.

FIGS. 5 and 6 show, by way of example, a cylindrical portion of an exhaust system equipped with a twin stainless steel sheet tube for obtaining, as suggested above, a further improved heat insulation. In FIG. 5, there are shown at 15 a flange for connection with the tube, an inner exhaust tube 16 for a cylinder, a first corrugated stainless steel tube 17 slipped over the outer surface of the tube 16 so as to provide a first air gap 19, and a second stainless steel corrugated sheet tube 18 slipped over the outer surface ofthe corrugated tube 17, so as to provide a second air gap 20: the two air gaps filled with stationary air thus form a twin insulating layer.

In FIG. 6, there have been truncated, at different distances apart from the flange (so as to render the drawing understandable) the inner tube 16, the first corrugated sheet metal tube 17 slipped thereover, and the second metal sheet tube 18. The drawing shows that the slope of the corrugations is different for the second tube with respect to the first so that the two lining tubes are not mutaully penetrated and spacing is ensured therebetween: consequently, the existence of the intermediate air layer is also warranted.

Figure 7:
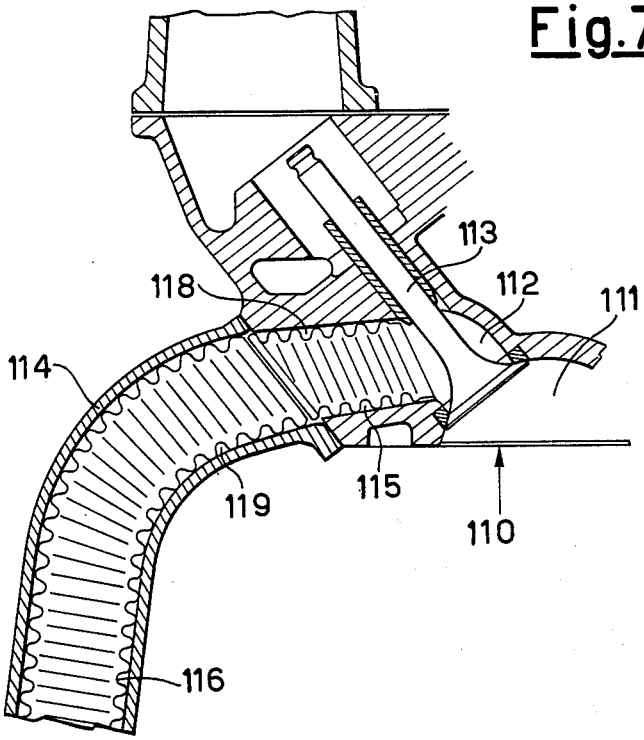
FIG. 7 is a part sectional view of the head of an internal combustion engine, taken in conjunction with the exhaust valve and the attendant exhaust duct, with the thermal insulation provided according to the invention.

In FIG. 7 there are indicated at 110 a head of a multicylinder engine, at 111 an explosion chamber of a cylinder (not shown), at 112 an exhaust duct formed in the head, at 113 an exhaust valve, whereas at 114 there is indicated an exhaust duct flangedly connected to the engine head in a conventional manner and thus not shown.

Internally of the duct 112, there is arranged a tube 115, preferably of stainless steel, which in the case in point is made of corrugated metal sheet. Internally of the duct 114 there is arranged a tube 116, also of stainless steel corrugated sheet.

Inasmuch as, as outlined above, the heat exchange through a gaseous fluid takes place by convection, the exhaust gas which stagnated in jackets 118 and 119 prevents the heat exchange by convection between the gases emitted by the engine and the walls of the exhaust ducts, with the transfer of conduction and irradiation being also considerably low on account of the low heat conductivity of stainless steel and the reflective power of its surfaces which remain glossy even with the lapse of time.

The corrugated metal sheet ensures an efficient dampening of the convective movements in the body of the gas which fills the jackets, but in a few sections, especially if these are rectilinear, the internal lining of the conveying system can be made with a smooth sheet metal whereas the corrugated sheet is preferred, on account of its bendability, in the portion having a curvilinear trend.

Upon assembly, the pieces of stainless steel sheet can be welded to the walls of the conveying system, with air-filled jackets being thus provided, which also are a very satisfactory insulation means. In such a case, corrugated sheets should be preferred altogether in order to prevent mechanical stresses which would be originated by the different expansions of the portions of the conveying system and the inside lining.

The tubular members inserted in the ducts of the conveying system, such as the tubes 115 and 116, can be made as single metal sheet piece, with the trend of the corrugations being perpendicular to the axis of the tube or also helical, or they can be obtained by helically winding a tape of longitudinally undulated sheet metal.

Figure 8:
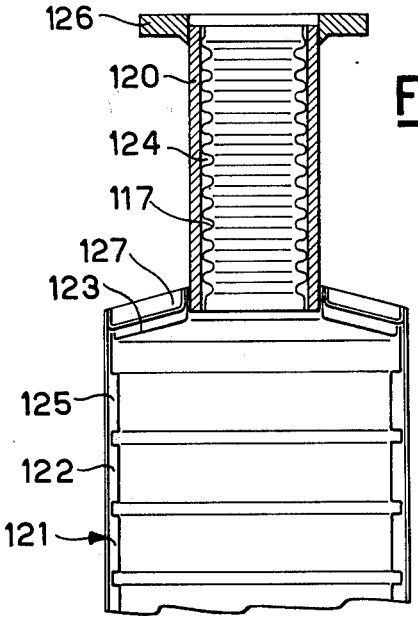
FIG. 8 is a partial illustration of the exhaust duct which conveys the gases toward the outside and which is also heat insulated.

In FIG. 8, there are indicted at 120 a duct in which the exhaust gases coming from the individual cylinders are combined, at 126 there is a flange which should be united to the corresponding counterflange of the area where the ducts coming from the engine heat (one of these can be seen in FIG. 7) merge into each other, at 121 there is indicted a muffler inserted in the same duct 120, a muffler which has a silencing effect if the requirement of an additional combustion of the unburned fractions present in the exhaust gases does not impose the use of post-combustion mufflers; as an alternative, it can be a catalytic muffler, a thermal reactor, in which case one or more silencing mufflers are mounted downstream. There are indicated at 117 a stainless steel tube made of corrugated sheet placed internally of the duct 120, at 122 and 123 metal sheets which line internally the muffler 121.

There are shown at 124, 125, and 127 the jackets thus obtained, in which the exhaust gas stagnates and which, as outlined above, are a considerable hindrance against heat transfer between the exhaust gases and the walls of the duct 120 and the muffler 121.

Figure 10:
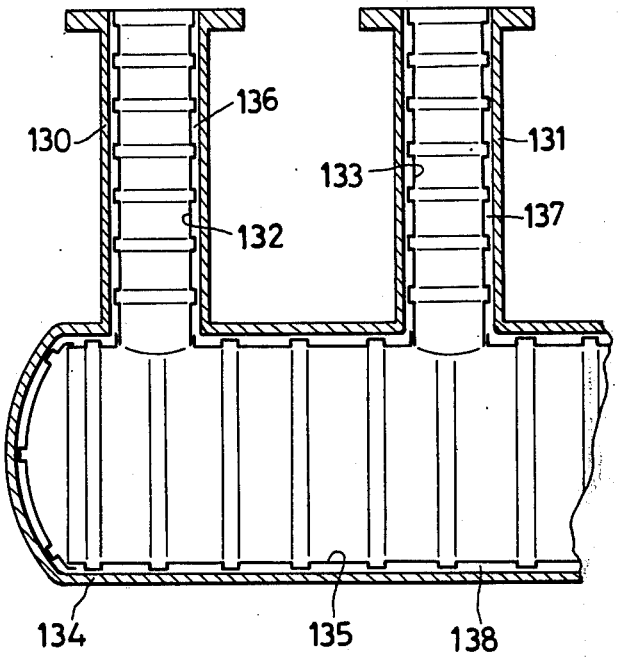
FIG. 10 illustrates a further embodiment.

The exhaust gas conveying system as shown in FIG. 10 comprises as many rectilinear axis ducts, flanged to the engine head, as there are cylinders (the drawing show at 130 and 131 two of these ducts) comprises, in addition, a chamber, shown at 134, where the ducts converge and one or more pipe sections (not shown) which emerge from the chamber 134 and discharge the gases towards the outside.

There are indicated at 132 and 133 stainless steel tubes, made of folded sheet metal, which are positioned in the inside of the ducts 130 and 131, and at 135 there is indicated an inner lining of the chamber 134, which is still made of folded sheet metal.

The exhaust gas which fills jackets 136, 137 and 138 prevents the heat transfer from the flowing gases to the walls of the ducts 130 and 131 and the chamber 134.

As outlined above, in the portions having a rectilinear axis, it is not required to use corrugated sheet metal (this is characterized by a good deformation ability and thus capable of matching the trend of the ducts) but it is preferable to have a partially folded smooth metal in order to provide an efficient dampening of the convective motion in the gas which fills the jackets 136, 137 and 138 thus providing an improved degree of thermal insulation.

Figure 9:
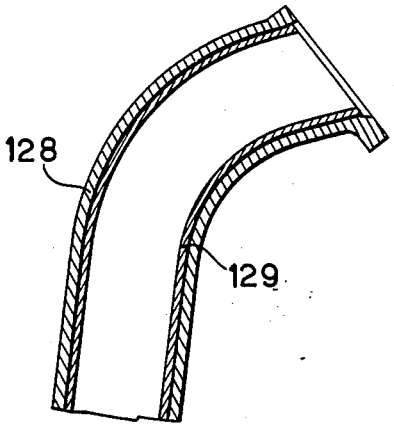
FIG. 9 is a sectional view of an alternative embodiment.

In FIG. 9, there are indicated at 128 an exhaust duct which is shown only in part, and at 129 a layer of a porous ceramic material which sticks to the walls of the duct and is affixed with appropriate adhesive means.

The exhaust gases which stagnate in the inside of the porous material layer enable a very efficient heat insulation to be provided without resorting to considerable thicknesses of ceramic material as a heat insulation layer such as would occur, for example, with a solid ceramic material.

Figure 11:
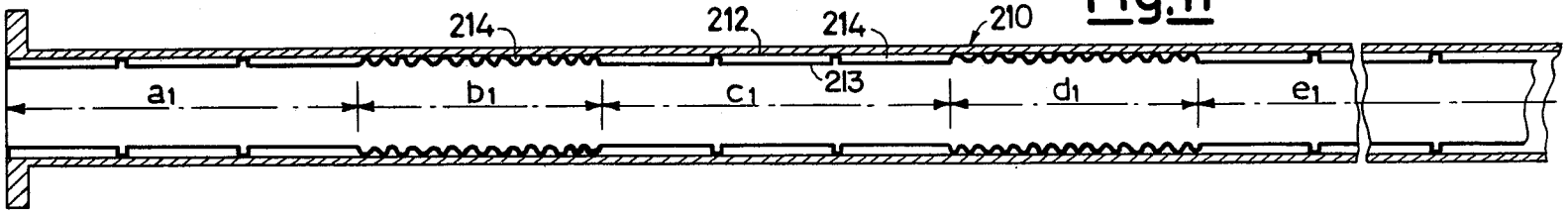
FIGS. 11 and 12 are sectional views showing an exhaust pipe provided with a smooth outer tube and a corrugated inner tube.
Figure 12:
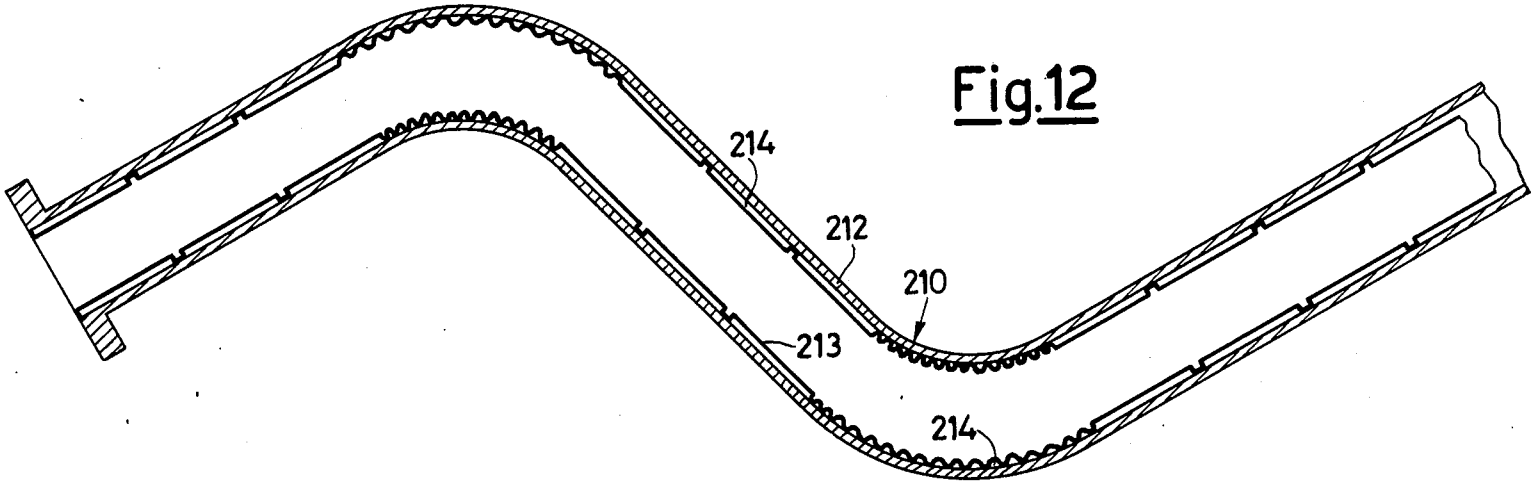

In FIGS. 11 and 12, there is shown an advantageous method for manufacturing an exhaust pipe 210 provided with a smooth outer tube and a corrugated inner tube.

An inner tube 213 is inserted into an outer tube 212 when both the tubes have rectilinear axes, as shown in FIG. 11; there are indicted at 214 jackets which are provided between the walls of the tubes or duct 212 and the tube 213, with the crests of the corrugations of the tube 214 being adherent to the inner surface of the duct 212 so that the inner tube is centered within the outer duct.

The duct 212 and the tube 213 are then conjointly bent and the herein considered section of the exhaust pipe reaches the desired final configuration; in FIG. 12 the accomplished pipe is shown as axially sectioned.

The inner tube 213 exactly follows the profile of the outer duct 212 without any distortion, since the very close corrugations of the sections $b_1$ and $d_1$ make it flexible enough to be bent without deformations; the corrugations of sections $a_1$, $C_1$ and $e_1$, which are more distant to each other, keep the tube 213 centered within the tube 12.

Since the walls provided with very close corrugations have been limited to the areas in which they are strictly necessary, the pressure loss of the gas which flows through the tube 213 in the operation of the motor are reduced.

Figure 13:
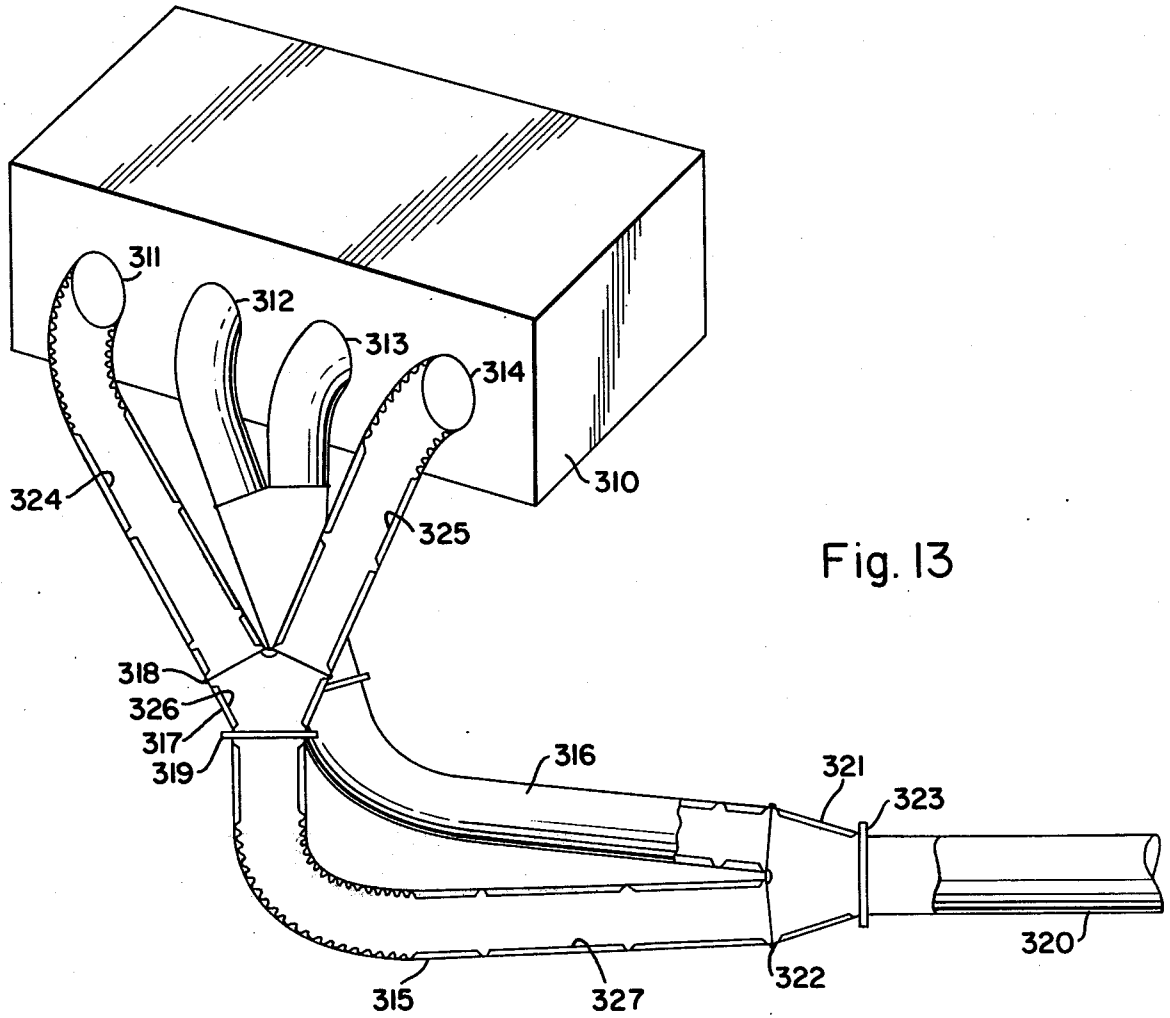
FIG. 13 is a diagrammatic view of a known exhaust system for a four cylinder engine illustrating the pipes of FIGS. 11 and 12 mounted between the head of the cylinder engine and the exhaust pipe of the vehicle.

In FIG. 13 is illustrated the details of a known exhaust system for a four cylinder engine in which exhaust pipes of the type disclosed in FIGS. 11 and 12 are employed. An engine head is denoted 310 and pipes 311, 312, 313, and 314 are connected to the respective cyliners of the engine. The pipes 311 and 314 join into a single pipe 315 and the pipes 312 and 313 join into a pipe 316. A joining member between the pipes 311 abd 314 denoted 317, is welded to the pipes while the mounting to the pipe 315 is accomplished by flanges 319. As identical joining member for the pipes 312 and 313 is provided but such joining member is not illustrated.

The pipes 315 and 316 join into an exhaust pipe 320 by which the exhaust gases are discharged to the atmosphere. The exhaust pipe 320 is ony partly illustrated and the silencing mufflers as well as possible post-combustion devices generally inserted in the pipe 320 are not illustrated.

A joining member 321 between the pipes 315 and 316 is welded to the pipes at 322 while the connection between the member 321 and the exhaust pipe 320 is effected by flanges 323.

In the initial part, i.e., that part closer to the engine head 310, the several exhaust pipes are internally insulated by tubes of suitable corrugated metal sheet, namely, formed according to the present invention with very close corrugations in the lengths having a curvilinear axis and with well-spaced corrugations in the rectilinear lengths as is readily apparent from the showing of pipes 311, 314, 315, and 316.

the pipes 311 and 314 are internally shielded by metal sheet tubes 324 and 325, respectively, and the joining member 317 is shielded by a metal sheet shell 326 which is welded at 318 to the joining member. The pipe 315 is inernally shielded by the tube 327.

An internal insulation of the same type is provided for the pipes 312, 313, and 316 while the pipe 320 generally is no insulated. However, a partial insulation of the initial length of the pipe 320 could be foreseen, if a post-combustion device is inserted in this pipe, to insure that the exhaust gases enter the post-combusiton device at the temperature as high as possible.

The present exhaust system can be manufactured in a very simple manner in accordance with FIGS. 11 and 12, even if the special arrangement of the pipes is somewhat complex. Moreover, the insulation is highly effective either due to the absence of convection motions within the hollow space between the pipes and the inner tubes, and because the contact areas between the confronting walls of the pipes and of the inner tubes are maintained at a minimum, thereby reducing the heat exchange by conduction between the inner tubes and the outer pipes.

This method for manufacturing the insulated tube can be used also when the corrugated tube is externally mounted.

What is claimed is:

1. An exhaust conveying system for internal combustion engines, having an engine head, a single exhaust manifold and a plurality of discrete exhaust pipes connecting the engine head to the single exhaust manifold, each of said exhaust pipe comprising at least a pair of tubular members, one member within the other member, including an outer smooth tubular member and an inner circumferentailly corrugated tubular member, said tubular members having curved sections and rectilinear sections, the corrugations of said inner tubular member extending over the whole circumference of said inner tubular member and the crests of the corrugations being adherent to the surface of the outer tubular member so as to define substantially closed air spaces between said tubular members, with the gaseous fluid contained in said spaces being stationary so as to reduce convection losses, the inner tubular member having corrugations which are closely spaced in proximity to said curved sections and corrugations in proximity to said rectilinear sections which are spaced at greater distances from one another.

2. The exhaust conveying system according to claim 1, wherein the inner corrugated tubular member is made of thin sheet metal of stainless steel.

* * * * *

UNITED STATES PATENT AND TRADEMARK OFFICE

CERTIFICATE OF CORRECTION

PATENT NO. : 4,022,019

DATED : May 10, 1977

INVENTOR(S) : GIAMPAOLO GARCEA

It is certified that error appears in the above-identified patent and that said Letters Patent are hereby corrected as shown below:

[30] Foreign Priority Document

Italian No. 28067 A/71 filed on August 31, 1971

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*